US006358072B1

(12) United States Patent
Johnson

(10) Patent No.: US 6,358,072 B1
(45) Date of Patent: Mar. 19, 2002

(54) AIRCRAFT IGNITION CABLE CONNECTOR

(76) Inventor: Howard R. Johnson, 1591 E. El Segundo Blvd., El Segundo, CA (US) 90245

( * ) Notice: Subject to any disclaimer, the term of this patent is extended or adjusted under 35 U.S.C. 154(b) by 0 days.

(21) Appl. No.: 09/652,982

(22) Filed: Aug. 31, 2000

(51) Int. Cl.[7] ..... H01R 13/44
(52) U.S. Cl. ..... 439/126; 123/633; 123/169 PH
(58) Field of Search ..... 439/125–128; 123/633, 169 PH, 169 PA

(56) References Cited

U.S. PATENT DOCUMENTS

| | | | | | |
|---|---|---|---|---|---|
| 2,109,030 | A | * | 2/1938 | Nowosielski | |
| 2,312,757 | A | * | 3/1943 | Frei | |
| 3,334,326 | A | * | 8/1967 | Besore et al. | |
| 3,965,879 | A | * | 6/1976 | Fitzner | 439/126 |
| 4,145,106 | A | * | 3/1979 | Livingston | 439/126 |
| 4,150,865 | A | * | 4/1979 | Iliff | |
| 4,978,309 | A | * | 12/1990 | Straub | 439/126 |
| 5,603,306 | A | * | 2/1997 | Tai | 439/126 |

* cited by examiner

*Primary Examiner*—Gary F. Paumen

(74) *Attorney, Agent, or Firm*—David A. Belasco; Beehler & Pavitt

(57) ABSTRACT

An aircraft ignition cable connector includes a radio-shielded ignition cable. The cable has an outer insulating cover, a shielding conductor, an inner insulating layer, and a center conductor. The cable is encased in a flexible, conducting, elbow tube. The elbow tube is attached at one end to the shielding conductor of the cable and attached at the other end to a metallic ferrule held to a threaded spark plug by an internally threaded nut. The elbow tube is capable of retaining a particular shape after bending. The elbow tube is formed from a sheet of malleable metallic material. The sheet has first and second, opposed parallel edges and third and fourth, opposed parallel edges normal to the first and second edges. The sheet has a series of single, back-to-back folds parallel to the third and fourth edges and is formed about a cylindrical mandrel with the long axis of the mandrel perpendicular to the folds. The first and second edges are joined to form an open-ended cylindrical tube that is shaped into the elbow. In a variant of the invention, lower portions of the back-to-back folds are doubled back upon themselves so as to provide four layers of metallic material adjacent the lower surface of the sheet. The sheet is formed about a cylindrical mandrel with the lower surface outermost with the long axis of the mandrel perpendicular to the folds. The first and second edges are joined to form an open-ended cylindrical tube that has a reinforced outer surface.

6 Claims, 4 Drawing Sheets

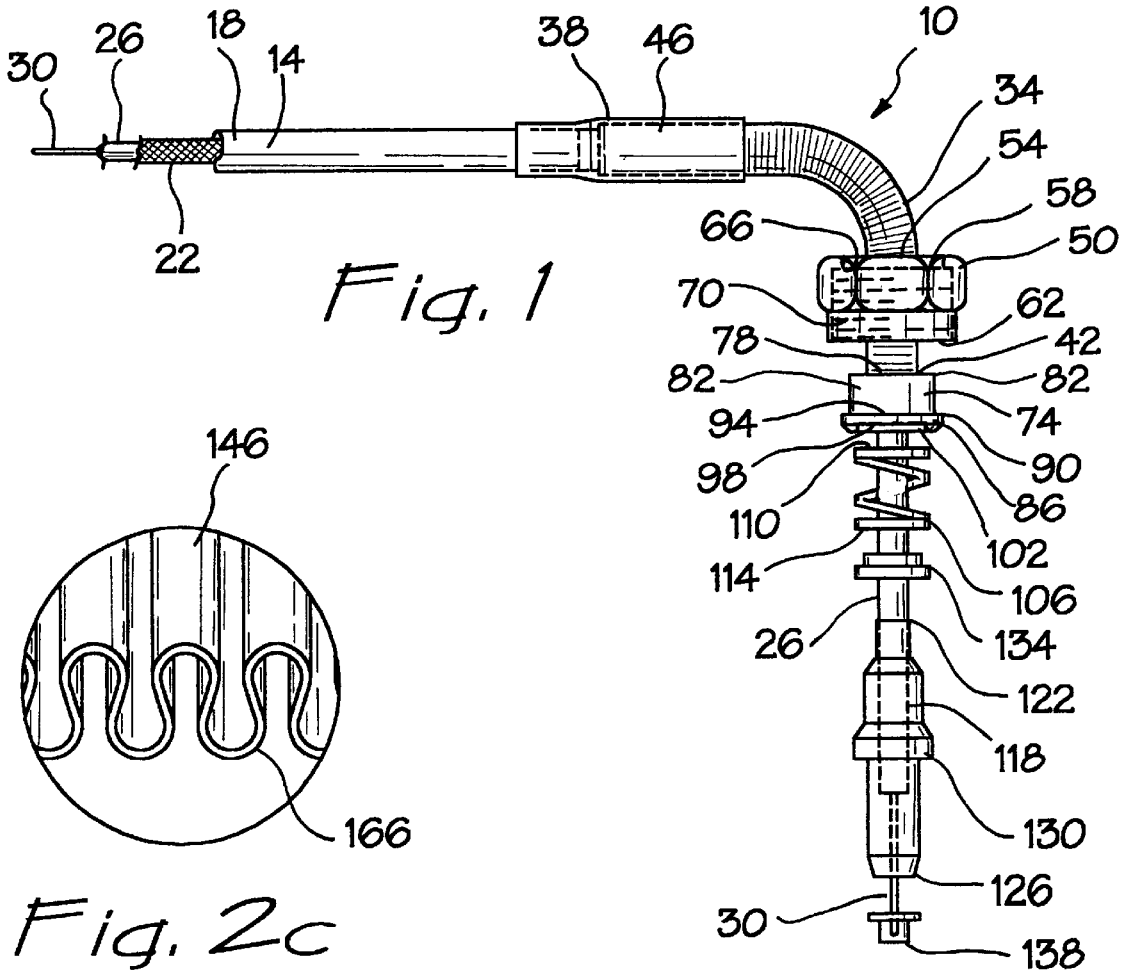
Fig. 1
Fig. 2c
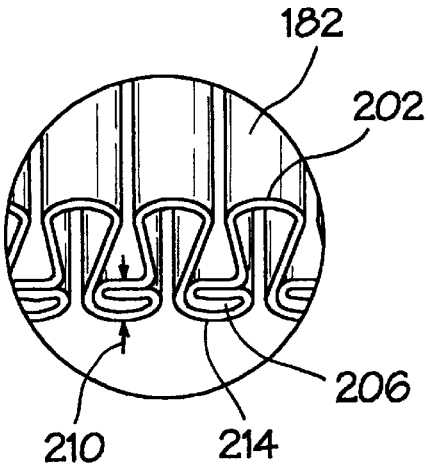
Fig. 4c 246
238
250
242
234
258
254
270
274
260
282
286
266
290
278
294
262
288
302
310
306
298
318
314
326
246
328
322
250
330
334
262
258
254
234
250
238
288
266
322
334

340

AIRCRAFT IGNITION CABLE CONNECTOR

FIELD OF INVENTION

The invention pertains to high voltage ignition cable connectors. More particularly, the invention relates to moisture proof connectors for spark plugs used in piston-type aircraft engines.

BACKGROUND OF THE INVENTION

Various types of high voltage ignition cable connectors have been developed for use in aircraft engines. U.S. Pat. No. 4,150,865 issued to Iliff discloses a spark plug connector including a threaded cap through which the high-tension lead passes. The cap threadedly engages an externally threaded metal cylindrical barrel encasing the spark plug insulator and contact. A coil spring and compressible tubular grommet, held in place by the cap, serve to seal the cable end and spark plug against moisture while providing a secure contact between the cable and the contact.

U.S. Pat. No. 2,109,030 issued to Nowosielski, is directed to an ignition apparatus and relates to spark plugs of aviation engines. The intent is to enclose all parts of the spark plug system so that high-tension current-carrying systems are protected and shielded so as to prevent interference with reception of radio signals. Insulating material covers the ignition wire with an outer metallic sheath. A swivel connection is soldered to the sheath which is detachable from a coupling nut, all of which provide the necessary protection.

U.S. Pat. No. 3,334,326, issued to Bedsore et al. is directed to a moisture proof connector for spark plugs associated with internal combustion engines. The moisture proof connector of this reference is especially useful in aircraft type engines that are susceptible to fouling due to the accumulation of moisture and dirt in the spark plug well. The insulated cable and grommet is a wire-meshed reinforced insulated conduit that is fastened to the upper end of the metal ferrule. The conduit, with its wire-meshed construction provides for the flexibility necessary in order to protect the cable.

U.S. Pat. No. 4,978,309 issued to Straub describes an igniter cable connector that is used in the high voltage electrical systems of an aircraft engine. The patent is intended to avoid flashover between the igniter insulator and the connector insulator and is accomplished by introducing a resilient seal between the insulators. In a first embodiment of the invention, a resilient annular seal is positioned on an end of the connector insulator adjacent to and surrounding the contact. The seal engages the contact as well as the insulator end and the wall of the igniter insulator bore end section. The seal has sufficient resilience to permit insertion of the seal into the igniter insulator bore without interference with the attachment of the connector to the igniter.

U.S. Pat. No. 2,312,757 issued to Frei discloses a radio shielded ignition apparatus, particularly to the connecting means for high-tension conductors in order to provide radio-shielded ignition circuits for internal combustion engines. The patent provides for the connection of the electrode with a source of high tension current by means of an insulated conductor. The conductor is shielded to prevent interference by means of a flexible metallic conduit along with a rigid metallic elbow wherein the conduit and elbow are connected together by a ferrule that telescopically receives the adjacent ends thereof.

While other variations exist, the above-described designs for aircraft ignition cable connector are typical of those encountered in the prior art. It is an objective of the present invention to provide a securely fastenable aircraft ignition cable connector that provides superior shielding for radio-frequency signals from high voltage ignition noise. It is a further objective to provide such shielding in a connector that provides complete sealing against moisture and dirt found in the aviation environment. It is yet a further objective to provide a connector with a flexible elbow tube that may be easily formed to a variety of required configuration without the use of special tools. It is an additional objective of the invention that the flexible elbow tube be capable of retaining its shape once formed, to simplify installation after spark plug service. It is a final further objective of the invention to provide the above described capabilities in an inexpensive and durable connector which is capable of extended duty cycles.

While some of the objectives of the present invention are disclosed in the prior art, none of the inventions found include all of the requirements identified.

SUMMARY OF THE INVENTION

The present invention addresses all of the deficiencies of prior aircraft ignition cable connector inventions and satisfies all of the objectives described above.

An aircraft ignition cable connector of the present invention may be constructed from the following components. A radio-shielded ignition cable is provided. The cable has an outer insulating cover, a shielding conductor, an inner insulating layer, and a center conductor. A flexible, conducting, elbow tube is provided. The elbow tube has a first end and a second end and is fixedly and conductively attached at its first end to the shielding conductor of the cable. The elbow tube is capable of retaining a particular shape after bending.

A sealing sleeve is provided. The sleeve joins the outer insulating cover to the first end of the elbow tube. A threaded nut is provided. The nut has a central orifice through it, a first end, a second end, a retaining lip at the first end and an internal thread extending from the econd end toward the retaining lip. A conducting ferrule is provided. The ferrule being cylindrical in shape, having a central orifice though it, and having a body portion and a retaining portion.

The body portion has a first end and a second end and is sized and shaped to fit slidably through the orifice in the threaded nut. The body portion is fixedly and conductively attached at its first end to the second end of the elbow tube. The retaining portion has a first end and a second end. The first end extends from the second end of the body portion and is sized and shaped to bear rotatably against the retaining lip of the threaded nut. The second end of the retaining portion includes a cylindrical recess.

A coil spring is provided. The coil spring has a first end and a second end. The first end is sized and shaped to rotatably engage the cylindrical recess. A cylindrical grommet is provided. The grommet has a first end, a second end, is formed of resilient, insulating material. The grommet is sized and shaped to fit slidably over the inner insulating layer of the cable. The grommet including a surrounding shoulder located between the first end and the second end. A washer is provided. The washer is sized and shaped to fit slidably over the first end of the grommet and bear against the surrounding shoulder. The coil spring is sized and shaped to surround the first end of the grommet and bear against the washer.

A spark plug lead button is provided. The button is fixedly and conductively attached to the center conductor of the cable adjacent the second end of the grommet. A cylindrical protector cap is provided. The cap is formed of insulating material and including an inner chamber and an external thread. The thread is size and shaped to engage the internal thread of the threaded nut.

In use, the protector cap is unthreaded from the threaded nut and the cable connector is inserted into a spark plug of an aircraft engine with the spark plug lead button bearing against a central spark plug conductor. When the threaded nut is threaded onto an external thread of the spark plug, the coil spring will be compressed, causing the spark plug lead button to bear against the central spark plug conductor, thereby providing a moisture-resistant connection between the cable and the sparkplug.

In a variant of the invention, the flexible, conducting, elbow tube is formed from a sheet of malleable metallic material. The sheet has first and second, opposed parallel edges and third and fourth, opposed parallel edges normal to the first and second edges. The sheet has a series of single, back to back folds parallel to the third and fourth edges and is formed about a cylindrical mandrel with a long axis of the mandrel perpendicular to the folds. The first and second edges are joined to form an open-ended cylindrical tube.

In a further variant, the flexible, conducting, elbow tube is formed from a sheet of malleable metallic material. The sheet has first and second, opposed parallel edges and third and fourth, opposed parallel edges normal to the first and second edges. The sheet has a series of single, back to back folds parallel to the third and fourth edges. Lower portions of the folds are doubled back upon themselves so as to provide four layers of metallic material adjacent a lower surface of the sheet. The sheet is formed about a cylindrical mandrel with the lower surface outermost with a long axis of the mandrel perpendicular to the folds. The first and second edges are joined to form an open-ended cylindrical tube that has a reinforced outer surface.

Yet another variant of the invention may be constructed from the following component. A radio-shielded ignition cable is provided. The cable has an outer insulating cover, a shielding conductor, an inner insulating layer, and a center conductor. A flexible, conducting, elbow tube is provided. The elbow tube has a first end and a second end and is fixedly and conductively attached at its first end to the shielding conductor of the cable. The elbow tube is capable of retaining a particular shape after bending.

A sealing sleeve is provided. The sleeve joins the outer insulating cover to the first end of the elbow tube. A threaded nut is provided. The nut has a central orifice through it, a first end, a second end, a retaining lip at the first end and an internal thread extending from the second end toward the retaining lip. A conducting ferrule is provided. The ferrule being cylindrical in shape, having a central orifice though it, and having a body portion and a retaining portion.

The body portion has a first end and a second end and is sized and shaped to fit slidably through the orifice in the threaded nut. The body portion is fixedly and conductively attached at its first end to the second end of the elbow tube. The retaining portion has a first end and a second end. The first end extends from the second end of the body portion and is sized and shaped to bear rotatably against the retaining lip of the threaded nut. The second end of the retaining portion includes a cylindrical recess.

A cylindrical grommet is provided. The grommet has a first end, a second end, is formed of resilient, insulating material. The grommet is sized and shaped to fit slidably over the inner insulating layer of the cable. The grommet includes a surrounding shoulder located adjacent to the first end. The shoulder is sized and shaped to fit frictionally within the cylindrical recess in the second end of the retaining portion of the ferrule.

A spark plug lead button is provided. The button is fixedly and conductively attached to the center conductor of the cable adjacent the second end of the grommet. A cylindrical protector cap is provided. The cap is formed of insulating material and includes an inner chamber and an external thread. The thread is size and shaped to engage the internal thread of the threaded nut.

In use, the protector cap is unthreaded from the threaded nut and the cable connector is inserted into a spark plug of an aircraft engine with the spark plug lead button bearing against a central spark plug conductor. When the threaded nut is threaded onto an external thread of the spark plug, the spark plug lead button will bear against the central spark plug conductor, thereby providing a moisture-resistant connection between the cable and the sparkplug.

The above variant may be used with either of the above-described flexible elbow tube designs.

DESCRIPTION OF THE DRAWINGS

FIG. 1 is an exploded side elevational view of the preferred embodiment of the invention including protective cap for a connector;

FIG. 2*c* is an enlarged, cross-sectional perspective of a section of the FIG. 2*b* embodiment taken along the line 2*c;*

FIG. 4*c* is an enlarged, cross-sectional perspective of a section of the FIG. 4*b* embodiment taken along the line 4*c*.

DETAILED DESCRIPTION OF THE PREFERRED EMBODIMENT

Figure 2:
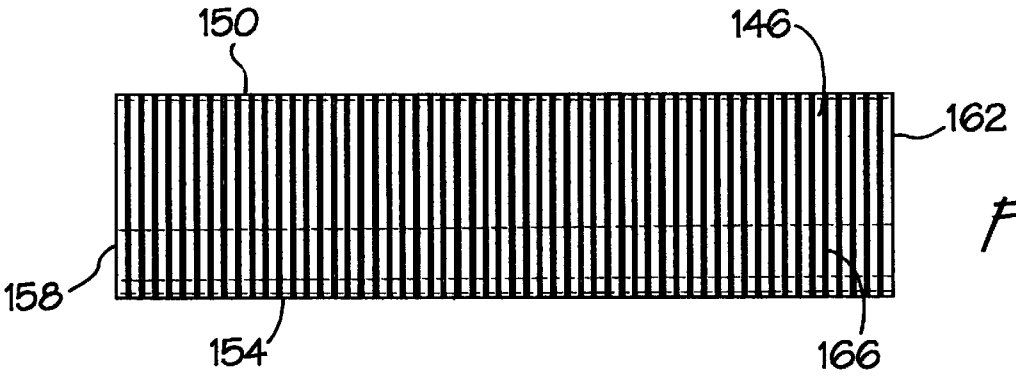
FIG. 2 is a plan view of a folded, metallic sheet from which a first embodiment of a flexible, conducting, elbow tube is formed.

FIG. 1 illustrates an aircraft ignition cable connector 10 of the present invention that may be constructed from the following components. A radio-shielded ignition cable 14 is provided. The cable 14 has an outer insulating cover 18, a shielding conductor 22, an inner insulating layer 26, and a center conductor 30. A flexible, conducting, elbow tube 34 is provided. The elbow tube 34 has a first end 38 and a second end 42 and is fixedly and conductively attached at its first end 38 to the shielding conductor 22 of the cable 14. The elbow tube 34 is capable of retaining a particular shape after bending.

A sealing sleeve 46 is provided. The sleeve 46 joins the outer insulating cover 18 to the first end 38 of the elbow tube 34. A threaded nut 50 is provided. The nut 50 has a central orifice 54 through it, a first end 58, a second end 62, a retaining lip 66 at the first end 58 and an internal thread 70 extending from the second end 62 toward the retaining lip 66. A conducting ferrule 74 is provided. The ferrule 74 being cylindrical in shape, having a central orifice 78 though it, and having a body portion 82 and a retaining portion 86.

The body portion 82 has a first end 88 and a second end 90 and is sized and shaped to fit slidably through the orifice 54 in the threaded nut 50. The body portion 82 is fixedly and conductively attached at its first end 88 to the second end 42 of the elbow tube 34. The retaining portion 86 has a first end 94 and a second end 98. The first end 94 extends from the second end 90 of the body portion 82 and is sized and shaped to bear rotatably against the retaining lip 66 of the threaded nut 50. The second end 98 of the retaining portion 86 includes a cylindrical recess 102.

A coil spring 106 is provided. The coil spring 106 has a first end 110 and a second end 114. The first end 110 is sized and shaped to rotatably engage the cylindrical recess 102. A cylindrical grommet 118 is provided. The grommet 118 has a first end 122, a second end 126, is formed of resilient, insulating material. The grommet 118 is sized and shaped to fit slidably over the inner insulating layer 26 of the cable 14. The grommet 118 including a surrounding shoulder 130 located between the first end 122 and the second end 126. A washer 134 is provided. The washer 134 is sized and shaped to fit slidably over the first end 122 of the grommet 118 and bear against the surrounding shoulder 130. The coil spring 106 is sized and shaped to surround the first end 122 of the grommet 118 and bear against the washer 134.

A spark plug lead button 138 is provided. The button 138 is fixedly and conductively attached to the center conductor 30 of the cable 14 adjacent the second end 126 of the grommet 118. A cylindrical protector cap 142 is provided. The cap 142 is formed of insulating material and including an inner chamber 146 and an external thread 150. The thread 150 is size and shaped to engage the internal thread 70 of the threaded nut 50.

In use, the protector cap 142 is unthreaded from the threaded nut 50 and the cable connector 10 is inserted into a spark plug (not shown) of an aircraft engine (not shown) with the spark plug lead button 138 bearing against a central spark plug conductor (not shown). When the threaded nut 50 is threaded onto an external thread (not shown) of the spark plug, the coil spring 106 will be compressed, causing the spark plug lead button 138 to bear against the central spark plug conductor, thereby providing a moisture-resistant connection between the cable 14 and the sparkplug.

Figure 2A:
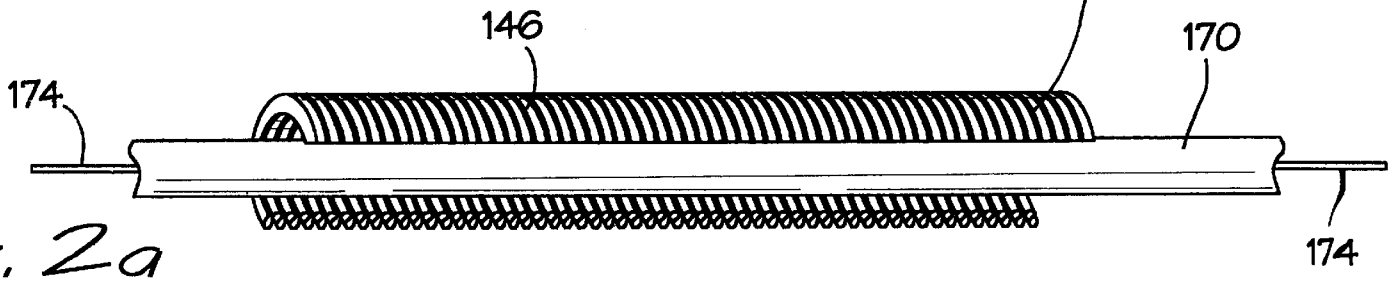
FIG. 2*a* is perspective view of the FIG. 2 embodiment being formed about a mandrel.
Figure 2B:
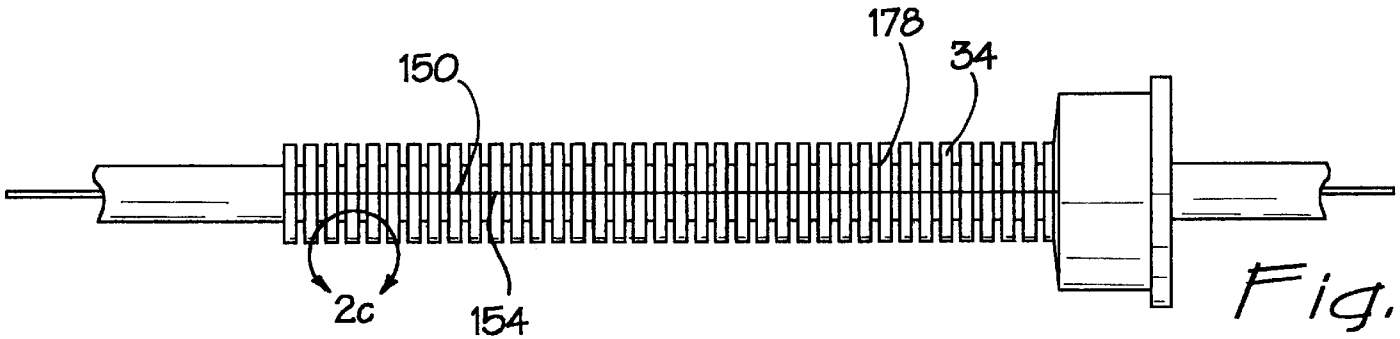
FIG. 2*b* is a side elevation of the first embodiment of a flexible, conducting, elbow tube.

In a variant of the invention, as illustrated in FIGS. 2, 2*a*, 2*b* and 2*c*, the flexible, conducting, elbow tube 34 is formed from a sheet 146 of malleable metallic material. As shown in FIG. 2, the sheet 146 has first 150 and second 154, opposed parallel edges and third 158 and fourth 162, opposed parallel edges normal to the first 150 and second 154 edges. As shown in FIG. 2*c*, the sheet 146 has a series of single, back-to-back folds 166 parallel to the third 154 and fourth 158 edges and is formed about a cylindrical mandrel 170 with a long axis 174 of the mandrel 170 perpendicular to the folds 166, as illustrated in FIG. 2*a*. As illustrated in FIG. 2*b*, the first 150 and second 154 edges are joined to form an open-ended cylindrical tube 178.

Figure 4:
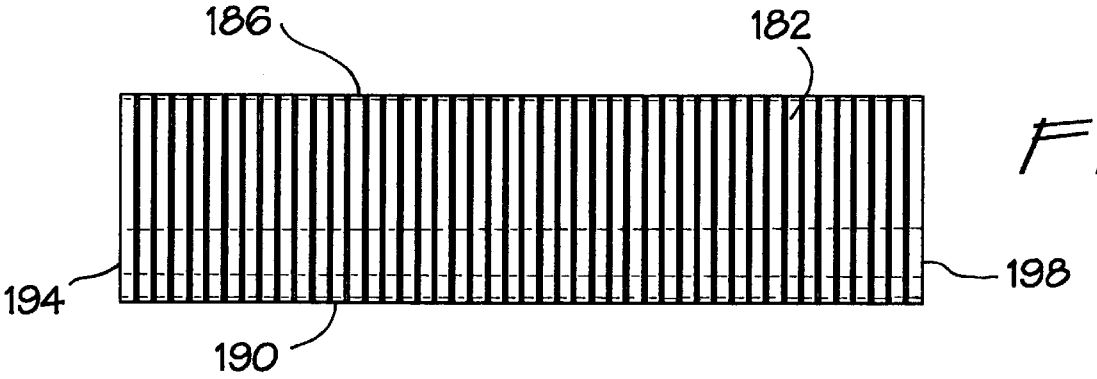
FIG. 4 is a plan view of a folded, metallic sheet from which a second embodiment of a flexible, conducting, elbow tube is formed.
Figure 4A:
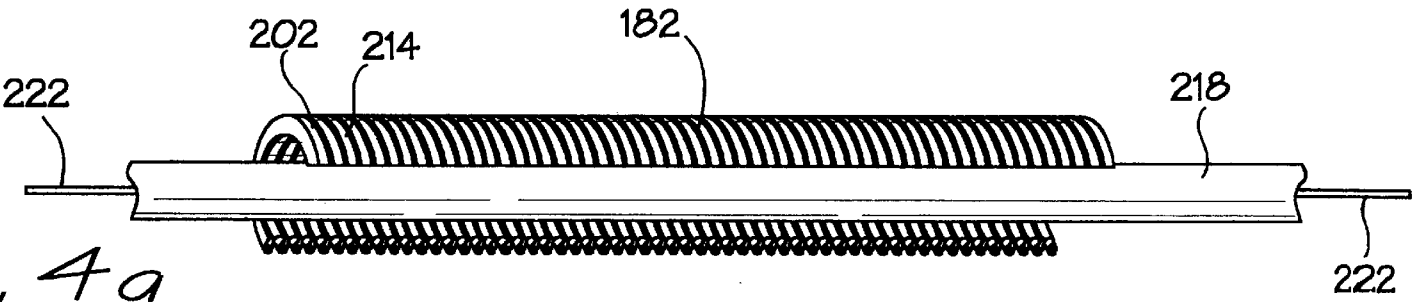
FIG. 4*a* is perspective view of the FIG. 4 embodiment being formed about a mandrel.
Figure 4B:
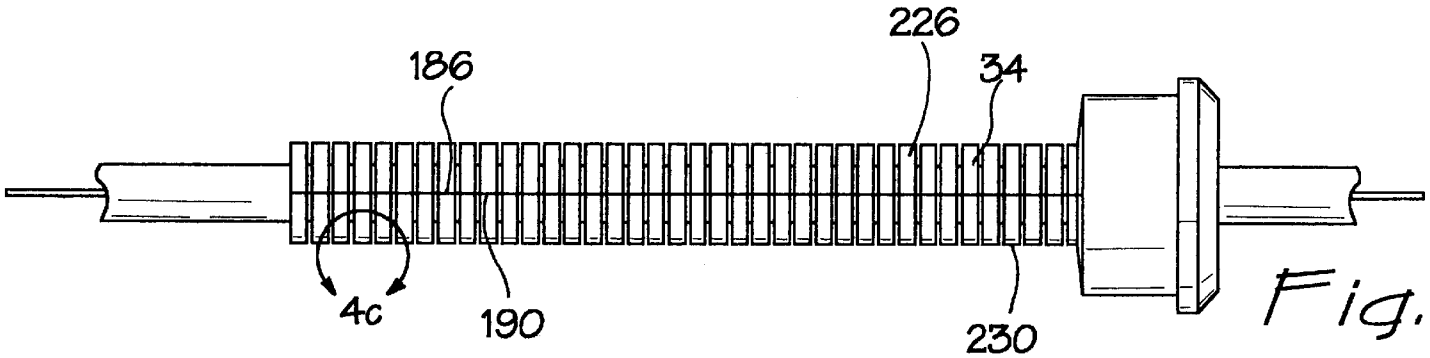
FIG. 4*b* is a side elevation of the first embodiment of a flexible, conducting, elbow tube.

In a further variant, as illustrated in FIGS. 4, 4*a*, 4*b* and 4*c*, the flexible, conducting, elbow tube 34 is formed from a sheet 182 of malleable metallic material. As shown in FIG. 4, the sheet 182 has first 186 and second 190, opposed parallel edges and third 194 and fourth 198, opposed parallel edges normal to the first 186 and second 190 edges. As shown in FIG. 4*c*, the sheet 182 has a series of single, back to back folds 202 parallel to the third 194 and fourth 198 edges. Lower portions 206 of the folds 202 are doubled back upon themselves so as to provide four layers 210 of metallic material adjacent a lower surface 214 of the sheet 182. The sheet 182 is formed about a cylindrical mandrel 218 with the lower surface 214 outermost with a long axis 222 of the mandrel 218 perpendicular to the folds 202 as illustrated in FIG. 4*a*. As illustrated in FIG. 4*b*, the first 186 and second 190 edges are joined to form an open-ended cylindrical tube 226 that has a reinforced outer surface 230.

Figures 3, 3A:
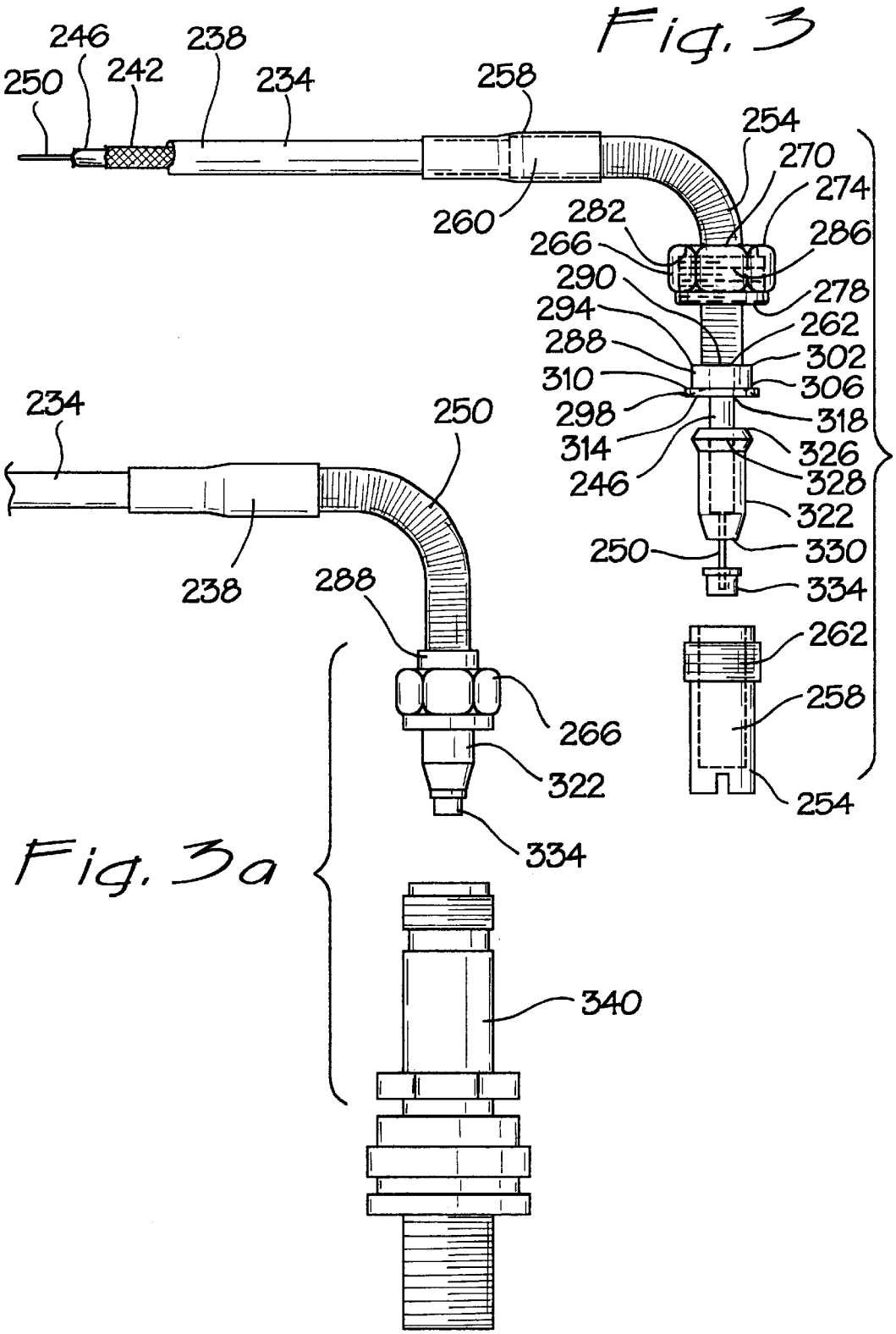
FIG. 3 is an exploded side elevational view of a second embodiment of the invention including protective cap for a connector.
FIG. 3*a* is a plan view of the FIG. 3 connector and a sparkplug of the type attachable to said connector.

As illustrated in FIGS. 3 and 3*a*, yet another variant of the invention may be constructed from the following component. A radio-shielded ignition cable 234 is provided. The cable 234 has an outer insulating cover 238, a shielding conductor 242, an inner insulating layer 246, and a center conductor 250. A flexible, conducting, elbow tube 254 is provided. The elbow tube 254 has a first end 258 and a second end 262 and is fixedly and conductively attached at its first end 258 to the shielding conductor 242 of the cable 234. The elbow tube 254 is capable of retaining a particular shape after bending.

A sealing sleeve 260 is provided. The sleeve 260 joins the outer insulating cover 238 to the first end 258 of the elbow tube 254. A threaded nut 266 is provided. The nut 266 has a central orifice 270 through it, a first end 274, a second end 278, a retaining lip 282 at the first end 274 and an internal thread 286 extending from the second end 278 toward the retaining lip 282. A conducting ferrule 288 is provided. The ferrule 288 being cylindrical in shape, having a central orifice 290 though it, and having a body portion 294 and a retaining portion 298.

The body portion 294 has a first end 302 and a second end 306 and is sized and shaped to fit slidably through the orifice 270 in the threaded nut 266. The body portion 294 is fixedly and conductively attached at its first end 302 to the second end 262 of the elbow tube 254. The retaining portion 298 has a first end 310 and a second end 314. The first end 310 extends from the second end 306 of the body portion 294 and is sized and shaped to bear rotatably against the retaining lip 282 of the threaded nut 266. The second end 314 of the retaining portion 298 includes a cylindrical recess 318.

A cylindrical grommet 322 is provided. The grommet 322 has a first end 326, a second end 330, is formed of resilient, insulating material. The grommet 322 is sized and shaped to fit slidably over the inner insulating layer 246 of the cable 234. The grommet 322 includes a surrounding shoulder 328 located adjacent to the first end 326. The shoulder 328 is sized and shaped to fit frictionally within the cylindrical recess 318 in the second end 314 of the retaining portion 298 of the ferrule 288.

A spark plug lead button 334 is provided. The button 334 is fixedly and conductively attached to the center conductor 250 of the cable 234 adjacent the second end 330 of the grommet 322. A cylindrical protector cap 254 is provided. The cap 254 is formed of insulating material and includes an inner chamber 258 and an external thread 262. The thread 266 is size and shaped to engage the internal thread 286 of the threaded nut 266.

In use, the protector cap 254 is unthreaded from the threaded nut 266 and the cable connector 10 is inserted into a spark plug 340 of an aircraft engine (not shown) with the spark plug lead button 334 bearing against a central spark plug conductor (not shown). When the threaded nut 266 is threaded onto an external thread (not shown) of the spark plug, the spark plug lead button 334 will bear against the central spark plug conductor, thereby providing a moisture-resistant connection between the cable 234 and the sparkplug 340.

The above variant may be used with either of the above-described flexible elbow tube 34, 254 designs. The aircraft ignition cable connector mechanism 10 has been described with reference to particular embodiments. Other modifications and enhancements can be made without departing from the spirit and scope of the claims that follow.

What is claimed is:

1. An aircraft ignition cable connector, comprising:

a radio-shielded ignition cable, said cable having an outer insulating cover, a shielding conductor, an inner insulating layer, and a center conductor;

a flexible, conducting, elbow tube, said elbow tube having a first end and a second end and being fixedly and conductively attached at its first end to the shielding conductor of said cable;

said elbow tube being capable of retaining a particular shape after bending;

a sealing sleeve, said sleeve joining said outer insulating cover to the first end of said elbow tube;

a threaded nut, said nut having a central orifice therethrough, a first end, a second end, a retaining lip at said first end and an internal thread extending from said second end toward said retaining lip;

a conducting ferrule, said ferrule being cylindrical in shape, having a central orifice therethrough, and having a body portion and a retaining portion;

said body portion having a first end and a second end and being sized and shaped to fit slidably through the orifice in the threaded nut and being fixedly and conductively attached at its first end to the second end of the elbow tube;

said retaining portion having a first end and a second end, said first end extending from the second end of the body portion and being sized and shaped to bear rotatably against the retaining lip of the threaded nut;

said second end of said retaining portion including a cylindrical recess;

a coil spring, said coil spring having a first end and a second end, said first end being sized and shaped to rotatably engage said cylindrical recess;

a cylindrical grommet, said grommet having a first end, a second end, being formed of resilient, insulating material and being sized and shaped to fit slidably over the inner insulating layer of the cable, said grommet including a surrounding shoulder disposed between said first end and said second end;

a washer, said washer being sized and shaped to fit slidably over the first end of the grommet and bear against said surrounding shoulder;

said coil spring being sized and shaped to surround the first end of the grommet and bear against the washer;

a spark plug lead button, said button being fixedly and conductively attached to the center conductor of the cable adjacent the second end of the grommet;

a cylindrical protector cap, said cap formed of insulating material and including an inner chamber and an external thread, said thread being size and shaped to engage the internal thread of the threaded nut; and whereby, when the protector cap is unthreaded from the threaded nut and the cable connector is inserted into a spark plug of an aircraft engine with the spark plug lead button bearing against a central spark plug conductor and when the threaded nut is threaded onto an external thread of the spark plug, the coil spring will be compressed, causing the spark plug lead button to bear against the central spark plug conductor, thereby providing a moisture-resistant connection between the cable and the sparkplug.

2. An aircraft ignition cable connector as described in claim 1 wherein the flexible, conducting, elbow tube is formed from a sheet of malleable metallic material, said sheet having first and second, opposed parallel edges and third and fourth, opposed parallel edges normal to said first and second edges, a series of single, back to back folds parallel to said third and fourth edges, said sheet being formed about a cylindrical mandrel, a long axis of said mandrel being perpendicular to said folds, said first and second edges being joined to form an open-ended cylindrical tube.

3. An aircraft ignition cable connector as described in claim 1 wherein the flexible, conducting, elbow tube is formed from a sheet of malleable metallic material, said sheet having first and second, opposed parallel edges and third and fourth, opposed parallel edges normal to said first and second edges, a series of single, back to back folds parallel to said third and fourth edges, lower portions of said folds being doubled back upon themselves so as to provide four layers of metallic material adjacent a lower surface of said sheet, said sheet being formed about a cylindrical mandrel with said lower surface outermost, a long axis of said mandrel being perpendicular to said folds, said first and second edges being joined to form an open-ended cylindrical tube having a reinforced outer surface.

4. An aircraft ignition cable connector, comprising:

a radio-shielded ignition cable, said cable having an outer insulating cover, a shielding conductor, an inner insulating layer, and a center conductor;

a flexible, conducting, elbow tube, said tube having a first end and a second end and being fixedly and conductively attached at its first end to the shielding conductor of said cable;

said elbow tube being capable of retaining a particular shape after bending;

a sealing sleeve, said sleeve joining said outer insulating cover to the first end of said elbow tube;

a threaded nut, said nut having a central orifice therethrough, a first end, a second end, a retaining lip at said first end and an internal thread extending from said second end toward said retaining lip;

a conducting ferrule, said ferrule being cylindrical in shape, having a central orifice therethrough, and having a body portion and a retaining portion;

said body portion having a first end and a second end and being sized and shaped to fit slidably through the orifice in the threaded nut and being fixedly and conductively attached at its first end to the second end of the elbow tube;

said retaining portion having a first end and a second end, said first end extending from the second end of the body portion and being sized and shaped to bear rotatably against the retaining lip of the threaded nut;

said second end of said retaining portion including a cylindrical recess;

a cylindrical grommet, said grommet having a first end, a second end, being formed of resilient, insulating material and being sized and shaped to fit slidably over the inner insulating layer of the cable, said grommet including a surrounding shoulder disposed adjacent said first end, said shoulder sized and shaped to fit frictionally within the cylindrical recess in the second end of the retaining portion of the ferrule;

a spark plug lead button, said button being fixedly and conductively attached to the center conductor of the cable adjacent the second end of the grommet;

a cylindrical protector cap, said cap formed of insulating material and including an inner chamber and an external thread, said thread being size and shaped to engage the internal thread of the threaded nut; and whereby, when the protector cap is unthreaded from the threaded nut and the cable connector is inserted into a spark plug of an aircraft engine with the spark plug lead button bearing against a central spark plug conductor and when the threaded nut is threaded onto an external thread of the spark plug, the spark plug lead button will bear against the central spark plug conductor, thereby providing a moisture-resistant connection between the cable and the sparkplug.

5. An aircraft ignition cable connector as described in claim 4 wherein the flexible, conducting, elbow tube is formed from a sheet of malleable metallic material, said sheet having first and second, opposed parallel edges and third and fourth, opposed parallel edges normal to said first and second edges, a series of single, back to back folds parallel to said third and fourth edges, said sheet being formed about a cylindrical mandrel, a long axis of said mandrel being perpendicular to said folds, said first and second edges being joined to form an open-ended cylindrical tube.

6. An aircraft ignition cable connector as described in claim 4 wherein the flexible, conducting, elbow tube is formed from a sheet of malleable metallic material, said sheet having first and second, opposed parallel edges and third and fourth, opposed parallel edges normal to said first and second edges, a series of single, back to back folds parallel to said third and fourth edges, lower portions of said folds being doubled back upon themselves so as to provide four layers of metallic material adjacent a lower surface of said sheet, said sheet being formed about a cylindrical mandrel with said lower surface outermost, a long axis of said mandrel being perpendicular to said folds, said first and second edges being joined to form an open-ended cylindrical tube having a reinforced outer surface.

* * * * *